US005710489A

United States Patent [19]

Nilssen

[11] Patent Number: 5,710,489

[45] Date of Patent: Jan. 20, 1998

[54] OVERVOLTAGE AND THERMALLY PROTECTED ELECTRONIC BALLAST

[76] Inventor: Ole K. Nilssen, 408 Caesar Dr., Barrington, Ill. 60010

[21] Appl. No.: 348,327

[22] Filed: Dec. 2, 1994

Related U.S. Application Data

[63] Continuation-in-part of Ser. No. 771,801, Oct. 7, 1991, abandoned, which is a continuation of Ser. No. 88,592, Aug. 24, 1987, abandoned, which is a continuation-in-part of Ser. No. 720,387, Apr. 5, 1985, Pat. No. 4,663,571, and a continuation-in-part of Ser. No. 720,386, Apr. 5, 1985, Pat. No. 4,675,576, and a continuation-in-part of Ser. No. 691,171, Jan. 14, 1985, Pat. No. 4,644,228, and a continuation-in-part of Ser. No. 686,447, Dec. 26, 1984, Pat. No. 4,638,395, and a continuation-in-part of Ser. No. 677,562, Dec. 3, 1984, Pat. No. 4,698,553, and a continuation-in-part of Ser. No. 612,058, May 18, 1984, Pat. No. 4,667,131, and a continuation-in-part of Ser. No. 605,479, Apr. 30, 1984, Pat. No. 4,626,953, which is a continuation-in-part of Ser. No. 720,387, Apr. 5, 1985, Pat. No. 4,663,571, which is a continuation-in-part of Ser. No. 720,386, Apr. 5, 1985, Pat. No. 4,675,576, which is a continuation-in-part of Ser. No. 691,171, Jan. 14, 1985, Pat. No. 4,644,228, which is a continuation-in-part of Ser. No. 686,447, Dec. 26, 1984, Pat. No. 4,638,395, which is a continuation-in-part of Ser. No. 677,562, Dec. 3, 1984, Pat. No. 4,698,553, which is a continuation-in-part of Ser. No. 612,058, May 18, 1984, Pat. No. 4,667,131, which is a continuation-in-part of Ser. No. 605,479, Apr. 30, 1984, Pat. No. 4,626,953, and a continuation-in-part of Ser. No. 640,240, Aug. 13, 1984, Pat. No. 4,563,719, and a continuation-in-part of Ser. No. 506,420, Jun. 21, 1983, Pat. No. 4,581,562, and a continuation-in-part of Ser. No. 500,841, Jun. 3, 1983, Pat. No. 4,538,095, and a continuation-in-part of Ser. No. 495,540, May 17, 1983, Pat. No. 4,554,487, and a continuation-in-part of Ser. No. 481,714, Apr. 4, 1983, Pat. No. 4,507,698, and a continuation-in-part of Ser. No. 456,276, Feb. 22, 1983, Pat. No. 4,503,363, and a continuation-in-part of Ser. No. 411,263, Aug. 25, 1982, Pat. No. 4,461,980.

[51] Int. Cl.[6] ..... G05F 1/00

[52] U.S. Cl. ..... 315/309; 315/291; 315/225; 315/209 R; 315/DIG. 7

[58] Field of Search ..... 315/291, 309, 315/224, 225, 244, 241 R, 276, 209 R, 206, DIG. 7

[56] References Cited

U.S. PATENT DOCUMENTS

| | | | |
|---|---|---|---|
| 3,889,153 | 6/1975 | Pierce | 315/209 R |
| 4,008,414 | 2/1977 | Agnew | 315/97 |
| 4,207,497 | 6/1980 | Capewell et al. | 315/96 |
| 4,370,600 | 1/1983 | Zansky | 315/244 |

*Primary Examiner*—Robert Pascal
*Assistant Examiner*—Haissa Philogene

[57] ABSTRACT

An inverter-type electronic fluorescent lamp ballast has means to disable inverter operation in case of an overvoltage condition and/or in case its internal temperature were to exceed a safe level, thereby to provide automatic protection against damage that might otherwise result from excessive voltage and/or temperatures.

15 Claims, 1 Drawing Sheet

OVERVOLTAGE AND THERMALLY PROTECTED ELECTRONIC BALLAST

RELATED APPLICATIONS

Instant application is a continuation-in-part of Ser. No. 07/771,801 filed Oct. 7, 1991 now abandoned; which is a continuation of Ser. No. 07/088,592 filed Aug. 24, 1987 now abandoned; which application Ser. No. 07/088,592 is also a contination-in-part of the following seven applications:

1. Ser. No. 06/720,387 filed Apr. 5, 1985, now U.S. Pat. No. 4,663,571;
2. Ser. No. 06/720,386 filed Apr. 5, 1985, now U.S. Pat. No. 4,675,576;
3. Ser. No. 06/691,171 filed Jan. 14, 1985, now U.S. Pat. No. 4,644,228;
4. Ser. No. 06/686,447 filed Dec. 26, 1984, now U.S. Pat. No. 4,638,395;
5. Ser. No. 06/677,562 filed Dec. 3, 1984, now U.S. Pat. No. 4,698,553;
6. Ser. No. 06/612,058 filed May 18, 1984, now U.S. Pat. No. 4,667,131;
7. Ser. No. 06/605,479 filed Apr. 30, 1984, now U.S. Pat. No. 4,626,953;

each one if which seven applications is a continuation-in-part of: (i) Ser. No. 06/640,240 filed Aug. 13, 1984, now U.S. Pat. No. 4,563,719; (ii) Ser. No. 06/506,420 filed Jun. 21, 1983, now U.S. Pat. No. 4,581,562; (iii) Ser. No. 06/500,841 filed Jun. 3, 1983, now U.S. Pat. No. 4,538,095; (iv) Ser. No. 06/495,540 filed May 17, 1983, now U.S. Pat. No. 4,554,487; (v) Ser. No. 06/481,714 filed Apr. 4, 1983, now U.S. Pat. No. 4,507,698; (vi) Ser. No. 06/456,276 filed Feb. 22, 1983, now U.S. Pat. No. 4,503,363; and (vii) Ser. No. 06/411,263 filed Aug. 25, 1982, now U.S. Pat. No. 4,461,980.

BACKGROUND OF THE INVENTION

Field of Invention

Instant invention relates to means for automatically protecting inverter-type electronic ballasts from excessive voltages and temperatures, particularly as accomplished by automatic inverter disablement.

SUMMARY OF THE INVENTION

Objects of the Invention

An object of the present invention is that of providing a cost-effective means for preventing an inverter-type electronic ballast from becoming a potential electric shock hazard and/or fire initiation hazard.

These as well as other objects, features and advantages of the present invention will become apparent from the following description and claims.

Brief Description

In its preferred embodiment, subject invention constitutes a series-excited parallel-loaded fluorescent lamp ballast comprising the following key component parts:

a source of DC voltage, which DC voltage is derived by rectification of the AC voltage from a regular 60 Hz power line;

an inverter connected with the source of DC voltage and operative to provide across an output a relatively high-frequency squarewave voltage, the inverter comprising a disable-means operative on receipt of a disable-signal to disable the inverter and thereby to remove the squarewave voltage from the output while also substantially reducing the power drawn by the inverter from the source of DC voltage;

a series LC circuit connected across the output, the LC circuit being substantially series-resonant at the fundamental frequency of the squarewave voltage;

a fluorescent lamp connected across the tank-capacitor of the LC circuit;

temperature sensor means operative to provide the disable signal whenever its temperature exceeds a predetermined level;

overvoltage sensor means operative to provide the disable signal whenever the magnitude of the voltage across the tank-capacitor exceeds a pre-established level; and whereby, if the magnitude of the voltage across the lamp and/or the temperature of the ballast were to become excessive, the inverter be disabled.

DESCRIPTION OF THE PREFERRED EMBODIMENT

Description of the Drawing

Figure 1:
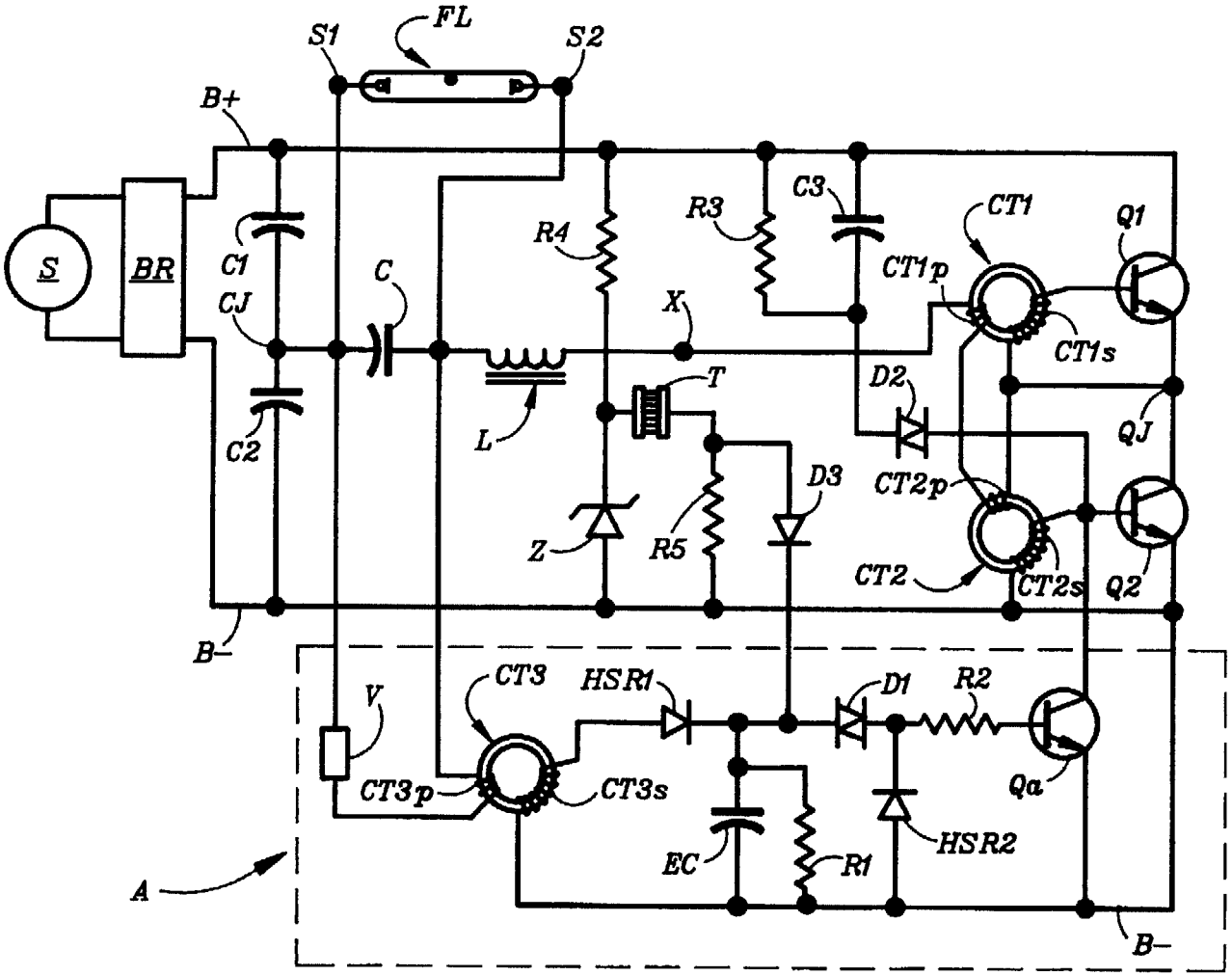
FIG. 1 schematically illustrates the preferred embodiment of the invention.

In FIG. 1, a source S of 120 Volt/60 Hz voltage is applied to a full-wave bridge rectifier BR, the unidirectional voltage output of which is applied directly between a B+ bus and a B− bus, with the positive voltage being connected to the B+ bus.

Between the B+ bus and the B− bus are connected a series-combination of two transistors Q1 and Q2 as well as a series-combination of two energy-storing capacitors C1 and C2.

The secondary winding CT1s of positive feedback current transformer CT1 is connected directly between the base and the emitter of transistor Q1; and the secondary winding CT2s of positive feedback current transformer CT2 is connected directly between the base and the emitter of transistor Q2.

The collector of transistor Q1 is connected directly with the B+ bus; the emitter of transistor Q2 is connected directly with the B− bus; and the emitter of transistor Q1 is connected directly with the collector of transistor Q2, thereby forming junction QJ.

One terminal of capacitor C1 is connected directly with the B+ bus, while the other terminal of capacitor C1 is connected with a junction CJ. One terminal of capacitor C2 is connected directly with the B− bus, while the other terminal of capacitor C2 is connected directly with junction CJ.

An inductor L and a capacitor C are connected in series with one another and with the primary windings CT1p and CT2p of current transformers CT1 and CT2.

The series-connected primary windings CT1p and CT2p are connected directly between junction QJ and a point X. Inductor L is connected with one of its terminals to point X and with the other of its terminals to one of the terminals of capacitor C. The other terminal of capacitor C is connected directly with junction CJ.

A fluorescent lamp FL is connected, by way of lamp sockets S1 and S2, in parallel-circuit across capacitor C.

A Varistor V and primary winding CT3p of current transformer CT3 are connected in series across capacitor C.

One terminal of the secondary winding CT3s of transformer CT3 is connected with the B– bus; the other terminal of this secondary winding is connected with the anode of a high speed rectifier HSR1. The cathode of rectifier HSR1 is connected to the positive terminal of an energy-storing capacitor EC. The negative terminal of capacitor EC is connected directly to the B– bus. A bleeding resistor R1 is connected directly across capacitor EC.

A Diac D1 is connected between the cathode of rectifier HSR1 and the cathode of another high speed rectifier HSR2. The anode of rectifier HSR2 is connected to the B– bus.

Between the cathode of rectifier HSR2 and the base of an auxiliary transistor Qa is connected a resistor R2.

The collector of transistor Qa is connected directly to the base of transistor Q2, and the emitter of transistor Qa is connected directly to B– bus.

The combination of varistor V, current transformer CT3, rectifier HSR1, capacitor EC, Resistor R1, Diac D1, rectifier HSR2, resistor R2 and transistor Qa is referred to as sub-assembly A.

A series-combination of a capacitor C3 and a Diac D2 is connected between the B+ bus and the base of transistor Q2. A resistor R3 is connected in parallel with capacitor C3.

A resistor R4 is connected between the B+ bus and the cathode of a Zener diode Z, whose anode is connected with the B– bus. A thermistor T is connected between the cathode of Zener diode Z and the anode of a diode D3, whose cathode is connected with the cathode of rectifier HSR1. A resistor R5 is connected between the anode of diode D3 and the B– bus.

Details of Operation

In FIG. 1, the source S represents an ordinary electric utility power line, the voltage from which is applied directly to the bridge rectifier identified as BR. This bridge rectifier is of conventional construction and provides for the rectified line voltage to be applied to the inverter circuit by way of the B+ bus and the B– bus.

The two energy-storing capacitors C1 and C2 are connected directly across the output of the bridge rectifier BR and serve to filter the rectified line voltage, thereby providing for the voltage between the B+ bus and the B– bus to be substantially constant. Junction CJ between the two capacitors serves to provide a power supply center tap.

The inverter circuit of FIG. 1, which represents a so-called half-bridge inverter, operates in a manner that is analogous with circuits previously described in published literature, as for instance in U.S. Pat. No. 4,184,128 entitled High Efficiency Push-Pull Inverters.

Upon initial application of power to the circuit, inverter oscillation is initiated by one or a few trigger pulses applied to the base of transistor Q2 by way of the combination of Capacitor C3 and Diac D2. Once the magnitude of the B+ voltage has stabilized, due to the effect of R3, periodic additional trigger pulses will be provided.

Under normal circumstances, these additional trigger pulses will have substantially no effect on the circuit. However, if for one reason or other inverter oscillations were to be interrupted, the trigger pulses will serve to restart the oscillations.

The output of the half-bridge inverter is a substantially squarewave 33 kHz AC voltage provided between point X and junction CJ. Directly across this output is connected a resonant or near-resonant L-C series circuit—with the fluorescent lamp connected in parallel with the tank-capacitor thereof.

The resonant or near-resonant action of the L-C series circuit provides for appropriate lamp starting and operating voltages, as well as for proper lamp current limiting; which is to say that it provides for appropriate lamp ballasting.

When the inverter is operating, the voltage developed across the tank-capacitor is essentially only limited by the voltage-clamping characteristics of either the fluorescent lamp FL or the Varistor V—i.e., by the one which clamps at the lower voltage. If the lamp is inoperable, or if the lamp is removed from the circuit, or during the brief period before the lamp ignites, the Varistor acts as the principal voltage-clamping means; and the circuit load current then flows through this Varistor. As soon as the lamp gets into operation, however, the voltage across the tank-capacitor (and thereby across the Varistor) falls to a magnitude that is so low that current will no longer flow through the Varistor.

In the arrangement of FIG. 1, the various relevant voltage and current magnitudes are approximately as follows: i) maximum required lamp starting voltage: 500 Volt RMS for not more than about 50 milli-Second; ii) Varistor RMS and peak clamping voltage, as well as energy-handling capability: 511 Volt RMS, 750 Volt and 40 Joules, respectively; lamp operating voltage and current: 140 Volt RMS and 0.2 Amp RMS, respectively.

In an LC series-resonant circuit, the power provided to a resistive load connected in parallel with the circuit tank-capacitor is approximately proportional to the magnitude of the load resistance. Hence, in FIG. 1, as long as the parameters of the LC circuit have been arranged to provide the fluorescent lamp with its required 0.2 Amp operating current at 140 Volt RMS (which corresponds to 28 Watt), the load power resulting at higher voltages will be roughly proportionately larger. Thus, at the point where the Varistor is clamping (at about 511 Volt RMS), the power provided to the Varistor is on the order of 100 Watt. However, since the fluorescent lamp is supposed to start within 500 milli-Second, the total cumulated energy dissipation in the Varistor is limited by the lamp to about 5 Joule.

That is, under normal conditions, current will flow through the Varistor for but a very brief period of time. Thereafter, the lamp starts and the Varistor in effect gets disconnected.

However, if the lamp is inoperative or not connected, the amount of energy that would be dissipated in the Varistor would rapidly exceed its energy-handling capability. In particular, for the parameters indicated above, the maximum energy capable of being absorbed by the Varistor would be reached in only 0.4 Second.

As long as current is flowing through the Varistor, it also flows through the primary winding CT3p of current-transformer CT3; which roughly implies that a corresponding output current can be obtained from the secondary winding CT3s. By way of rectifier HSR1, the positive component of this output current is used for charging energy-storing capacitor EC; which, after a brief period, accumulates a charge and develops a corresponding voltage. After this capacitor voltage has reached a magnitude high enough to cause the Diac D1 to break down, the accumulated charge on the capacitor is discharged into the base of transistor Qa—the magnitude of the discharge current being limited by the resistance of R2.

With a Diac breakdown voltage of about 30 Volt and a capacitance value of 33 uF for the energy-storing capacitor EC, the amount of charge accumulated at the point of breakdown is about 1 milli-Coulomb. Thus, if the breakdown is to occur in a time period of about 250 milli-Second (which is chosen as being a suitable value), the magnitude of the current supplied to the capacitor would have to be about 10 milli-Amp; which is indeed what is approximately provided in the circuit of FIG. 1.

Now, as the Diac breaks down, the 1 milli-Coulomb charge on capacitor EC discharges into the base of Qa—limited mainly by the resistance of R2. With the Qa transistor being thusly switched into a conductive state, albeit for just a brief moment, a very low impedance path is provided between the base and the emitter of transistor Q2. As a result, the inverter feedback path is broken and the inverter stops oscillating.

And, of course, once it has stopped oscillating, the inverter will not restart until trigger pulses are provided by way of Diac D2; which pulses will be provided periodically due to the effect of resistor R3. Thus, after a predetermined period, the inverter will restart; but, except if now operating properly, it will be disabled again almost immediately.

However, the key aspect of the present invention is associated with the effects of elements R4, Z, T, R5 and D3.

Resistor R4 is operative to cause a current to flow through Zener diode Z, which has a Zenering-voltage of about 50 Volt, thereby establishing a substantially constant-magnitude 50 Volt DC voltage thereacross.

The 50 Volt DC voltage is voltage-divided by way of thermistor T and resistor R5; and the divided voltage is applied to energy-storing capacitor EC by way of diode D3. Thus, when the divided voltage reaches a magnitude of about 30 Volt, EC will eventually reach a voltage large enough to cause Diac D1 to break over, thereby disabling the inverter.

Due to the basic nature of a Thermistor, its resistance will decrease gradually though significantly with temperature; which means that the magnitude of the divided voltage will correspondingly increase with temperature.

Values of Thermistor T and resistor R5 are so chosen that the divided voltage will reach 30 Volt at a temperature of about 90 degrees Centigrade; which means that a disable signal will then be provided, thereby to disable the inverter.

After a predetermined time, the inverter will be triggered into oscillation again, but only to be disabled immediately except if the temperature has decreased substantially.

Additional Comments (a) As the temperature of Thermistor T increases, the magnitude of the divided voltage increases correspondingly, thereby providing for a temperature-dependent voltage-bias on energy-storing capacitor EC. In turn, this implies that the time it takes for the Varistor current (indirectly) to charge capacitor EC to the point of Diac breakover will be shorter at higher temperatures—a feature that is generally advantageous: preventing the fluorescent lamp from getting ignited until the temperature has fallen substantially below the point at which the divided voltage is by itself is large enough to cause Diac breakover.

(b) In the circuit of FIG. 1, if fluorescent lamp FL were to be removed or otherwise fail to provide a proper loading for tank-capacitor C, the circuit will enter a mode whereby it will provide between its output terminals (i.e., the terminals of sockets S1 and S2) a high-frequency voltage that alternates at la relatively low frequency (e.g., one cycle per second) between being of a relatively high magnitude (e.g. 500 Volt RMS) and being of a relatively low magnitude (e.g., zero), spending a relatively brief amount of time (e.g., 100 milli-seconds) being at the relatively high magnitude and a relatively long time (e.g., 900 milli-seconds) being at the relatively low magnitude.

Thus, with the lamp removed from its sockets, the ballast output voltage is a high-frequency (e.g., 33 kHz) voltage amplitude modulated at a low frequency (e.g., 1 Hz); whereas, with the lamp in its sockets and drawing a proper amount of power, the ballast output voltage is a high-frequency voltage of substantially constant amplitude.

(c) The value of resistor R1 is such as to provide for a slow discharge of energy-storing capacitor C3.

In accurately calculating the voltage-division-ratio associated with the Thermistor and R5, it is necessary to consider the extra loading caused by leakage resistor R1.

In fact, in many cases, R5 may be eliminated and its effect be provided by a properly chosen R1.

(d) The RMS magnitude of the (high-frequency) voltage required to properly instant-start a fluorescent lamp is usually at least 3.3 times as high as that of the voltage developing across the lamp under normal full-power operation. Thus, an open circuit ballast output voltage of 500 Volt RMS would be appropriate for a lamp with normal full-power operating voltage of about 150 Volt RMS.

Thus, with a lamp having a full-power operating voltage of 150 Volt RMS, the circuit arrangement of FIG. 1 would appropriately have the following characteristics:

(i) with fluorescent lamp FL connected and drawing full power, the RMS magnitude of the voltage across lamp FL, and thereby between the socket terminals of sockets S1 and S2, is about 150 Volt RMS and substantially constant;

(ii) with lamp FL not connected, the RMS magnitude of the voltage between the socket terminals periodically varies between zero and 500 Volt RMS: being at zero magnitude for about 90% of the time and at 500 Volt RMS for about 10% of the time, thereby having an average RMS magnitude of about 50 Volt RMS;

(iii) which means that, with the lamp not connected, the high-frequency (33 kHz) voltage existing between the socket terminals is amplitude-modulated at a relatively low frequency (e.g., or 1 Hz), in that the amplitude of this high-frequency voltage periodically (at 1 Hz) alternates between having zero magnitude and having a 500 Volt RMS magnitude;

(iv) which further means that, with the lamp not connected, the RMS magnitude of the amplitude-modulated voltage present between the socket terminals—as measured over an integrating period of a complete modulation cycle—is the square root of: (the square of 500 Volt RMS divided by 10), which is the same as 500 Volt RMS divided by the square root of 10; which is to say, about 158 Volt RMS. In other words, in terms of net RMS value (i.e., net power generating effect), a voltage of 500 Volt RMS magnitude existing for 10% of the time during a period where the magnitude is zero during the remaining 90% of the period, is equivalent to a voltage of 158 Volt RMS existing throughout the whole period. Thus, since the magnitude of the voltage existing between the socket terminals when the lamp is connected is about 150 Volt RMS, it is noted that the long term RMS magnitude of the voltage existing between the socket terminals is about the same (i.e., 158 Volt RMS) when the lamp is not connected. However, by making the duty-cycle of the modulation a little smaller (e.g., more than about 12), the RMS magnitude of the voltage between the socket terminals could be made to be smaller when the lamp is not connected versus what it is when the lamp is connected.

Thus, with particular reference to FIG. 1 and Items (ii) through (iv) above, it is seen that, whenever the lamp is not connected, the voltage provided between the socket terminals is a high frequency AC voltage that is amplitude-modulated at a relatively low frequency (e.g., 1 Hz), where the relatively low frequency is low relative to the frequency of the high frequency (e.g., 33 kHz) AC voltage. In the particular embodiment herein disclosed, with the lamp not connected, the AC voltage between the socket terminals is represented by periodic bursts of high-frequency AC voltage.

Also, with particular reference to FIG. 1 and Items (i) and (ii) above, it is seen that: whenever the lamp is connected with the socket terminals, the AC voltage thereacross exhibits a first magnitude, namely a steady or non-varying RMS magnitude (e.g., 150 Volt) with a corresponding peak-to-peak magnitude (e.g., 424 Volt); and whenever the lamp is not so connected, the AC voltage across the lamp terminals exhibits a second magnitude. This second magnitude is characterized by varying between zero and a very high maximum RMS or peak-to-peak level (e.g., 500 Volt RMS or 1400 Volt peak-to-peak), with an average RMS magnitude far lower than the maximum level (e.g., an average of 50 Volt RMS). Thus, it is seen that the AC voltage across the lamp terminals exhibits a first peak-to-peak magnitude whenever the lamp is connected between the lamp terminals, and a second peak-to-peak magnitude whenever the lamp is not so connected, with the second peak-to-peak magnitude being distinctly higher than the first peak-to-peak magnitude. Further, it is seen that the RMS magnitude of the AC voltage between the lamp terminals is distinctly higher when the lamp is connected thereacross as compared with a situation when the lamp is not so connected.

(e) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a source operative to provide a DC voltage across a pair of DC terminals;

a lamp holder having a pair of lamp sockets operative to receive and hold a gas discharge lamp; the lamp holder having a pair of socket terminals; and an assembly connected with the DC terminals and the socket terminals; the assembly being functional: (i) as long as the lamp is connected with the socket terminals, to deliver a lamp current thereto; and (ii) whenever the lamp is not so connected, to provide across the socket terminals a high frequency AC voltage that is amplitude-modulated at a low frequency; high frequency being defined as a frequency higher than 10 kHz; low frequency being defined as a frequency lower than 100 Hz; the assembly being further characterized by not including a thermal circuit breaker functional to make and break connection between two terminals by way of a thermally activated mechanical contactor means.

2. The arrangement of claim 1 wherein the assembly is further characterized by including a control sub-assembly operative, on receipt of a first control action at a control action input, to cause a substantial reduction of the magnitude of any voltage present across the socket terminals.

3. The arrangement of claim 2 wherein the assembly is still further characterized by including a restoring sub-assembly operative, whenever the magnitude of any voltage present across the socket terminals has remained below a certain low level for longer than a certain length of time, to cause a substantial increase in this magnitude.

4. The arrangement of claim 1 wherein the assembly is further characterized by including a control sub-assembly operative, on receipt of a control action at a control action input, to stop delivery of the lamp current even under a condition when the lamp is connected with its socket terminals.

5. The arrangement of claim 4 wherein the control sub-assembly is further characterized by including a temperature sensing sub-circuit operative to supply said control action in case a temperature associated with the assembly were to exceed a predetermined level.

6. An arrangement comprising:

a source operative to provide a DC voltage across a pair of DC terminals;

a lamp holder having a pair of lamp sockets operative to receive and hold a gas discharge lamp; the lamp holder having a pair of socket terminals; and an assembly connected in circuit with the DC terminals and the socket terminals; the assembly being functional to provide an AC output voltage to the socket terminals; the assembly including a control sub-assembly connected in circuit therewithin and being operative to affect the RMS magnitude of the AC voltage in response to a control action received at a control action input; the assembly being further characterized by being operative, whenever the lamp is connected with the socket terminals, to cause a lamp current to flow through the lamp and to cause the RMS magnitude of the AC voltage to assume a first average level; and (ii) whenever the lamp is not connected with the socket terminals, to cause provision of said control action to the control action input, thereby to cause the RMS magnitude of the AC voltage to assume a second average level; the second average level being distinctly lower than the first average level.

7. The arrangement of claim 6 wherein the control sub-assembly is further characterized by causing, whenever the lamp is disconnected from the socket terminals, the AC voltage to be amplitude-modulated at a low frequency; the low frequency being lower than the frequency of the AC voltage by a factor higher than one hundred.

8. The arrangement of claim 7 wherein, whenever the lamp is disconnected from the socket terminals, the AC voltage comprises periodic bursts of high-frequency AC voltage; each burst of high-frequency AC voltage having a certain high-level RMS magnitude and being followed by a period during which the RMS magnitude of any voltage then present at the socket terminals is substantially lower than said high-level RMS magnitude.

9. The arrangement of claim 8 wherein the assembly is further characterized in that whenever the lamp is: (i) connected with the socket terminals, the AC voltage exhibits a first peak-to-peak magnitude; and (ii) not connected with the socket terminals, the AC voltage exhibits a second peak-to-peak magnitude; the second peak-to-peak magnitude being distinctly higher than the first peakto-peak magnitude.

10. An arrangement comprising:

source means operative to provide a DC voltage across a pair of DC terminals;

a lamp holder having a pair of lamp sockets operative to receive and hold a gas discharge lamp; the lamp holder having a pair of socket terminals; and inverter power supply means connected in circuit between the DC terminals and the socket terminals; the inverter power supply means: (i) being operable to provide an inverter output voltage between the socket terminals; (ii) being operable to properly power the gas discharge lamp as long as this gas discharge lamp is indeed being held by the lamp sockets; and (iii) having control means functional to control the magnitude of the inverter output voltage such as to prevent its RMS magnitude from exceeding a predetermined level; the control means being further characterized by not including a thermal circuit breaker functional to make and break connection between two terminals by way of a thermally activated mechanical contactor means.

11. An arrangement comprising:

rectifier means adapted to connect with an ordinary electric utility power line and, when so connected, to provide a DC voltage at a DC output;

self-oscillating inverter means connected with the DC output and, except after having been provided with a disable signal at a disable input, operable to convert the DC voltage to a high frequency voltage provided at an inverter output;

connect and matching means connected with the inverter output and operative to connect with a gas discharge lamp means, thereby to properly power that lamp means; and temperature sensor means responsive to a temperature associated with the inverter means; the temperature sensor means being connected with the disable input and operative, whenever the temperature exceeds a predetermined level, to provide the disable signal; the temperature sensor means being further characterized by including an element whose electrical characteristics changes gradually but substantively as a result of gradual changes in said temperature;

restart means connected with the inverter means and operative, after a predetermined period, to cause the inverter means to resume converting the DC voltage to the high frequency voltage;

thereby, whenever the temperature has exceeded a predetermined level: (i) to disable the inverter means, therefore preventing it from converting the DC voltage to the high frequency voltage; (ii) substantially to cease supplying power to the lamp means; and (iii) substantially to stop the rectifier means from drawing power from the power line; and (iv) after the predetermined period, to cause the inverter means to attempt but fail to resume supplying power to the lamp means.

12. An arrangement comprising:

rectifier connected with an ordinary electric utility power line and operative to provide a DC voltage at a DC output;

self-oscillating inverter connected with the DC output and, except after having been provided with a disable signal at a disable input, operative to provide a high frequency voltage at an inverter output;

connect and matching means connected with the inverter output and operative to connect with a gas discharge lamp means, thereby to provide power to the lamp means;

temperature sensor means responsive to a temperature associated with the inverter and operative whenever that temperature exceeds a predetermined level, to provide the disable signal, thereby to disable the inverter and to cease to provide power to the lamp means; the temperature sensor means being further characterized by including an element whose electrical characteristics changes gradually but substantively as a result of gradual changes in said temperature; and restart means connected in circuit with the inverter and operative to cause the inverter to re-start its operation some time after it has been disabled.

13. An improvement for a power supply for a lamp; the power supply comprising self-oscillating inverter connected with a DC voltage and operable to convert the DC voltage to a high frequency voltage, therewith to power the lamp; the improvement comprising:

disable means connected with the self-oscillating inverter; the disable means comprising an element whose electrical characteristics changes gradually but substantively as a result of gradual changes in a temperature associated with the inverter; the disable means being operable, whenever the temperature exceeds a predetermined level, to disable the self-oscillating inverter and thereby to prevent it from converting the DC voltage to the high frequency voltage; the disable means including automatic restart circuitry operative to cause the inverter to re-initiate its oscillation and to resume providing power to the lamp.

14. An arrangement comprising:

a source operative to provide a DC voltage of substantially constant magnitude across a pair of DC terminals;

a lamp holder having a pair of lamp sockets operative to receive and hold a gas discharge lamp; the lamp holder having a pair of socket terminals; and an assembly connected in circuit with the DC terminals as well as with the socket terminals; the assembly being operative, whenever the lamp is not connected with the socket terminals, to provide thereacross an AC voltage amplitude-modulated at a frequency no higher than one hundredth that of the AC voltage; the assembly being further characterized by not including a thermal circuit breaker functional to make and break connection between two terminals by way of a thermally activated contactor means.

15. An arrangement comprising:

a source operative to provide a DC voltage of substantially constant magnitude across a pair of DC terminals;

a lamp holder having a pair of lamp sockets operative to receive and hold a gas discharge lamp; the lamp holder having a pair of socket terminals; and an assembly connected in circuit with the DC terminals as well as with the socket terminals; the assembly being operative: (i) whenever the lamp is connected with the socket terminals, to supply to the lamp an alternating current of substantially constant amplitude; and (ii) whenever the lamp is not so connected, to provide across the socket terminals an AC voltage whose RMS magnitude varies periodically at a relatively low frequency; the frequency of the AC voltage being at least one hundred times higher than that of the relatively low frequency; the assembly being further characterized by not including a thermal circuit breaker functional to make and break connection between two terminals by way of a thermally activated contactor means.

* * * * *